US007533712B2

(12) United States Patent
Whittemore et al.

(10) Patent No.: US 7,533,712 B2
(45) Date of Patent: May 19, 2009

(54) PARTITION MOUNT WITH EXTENDED-LENGTH HEAD

(75) Inventors: Jeffrey P. Whittemore, Arlington, MA (US); Michael D. Cattafe, Bolton, MA (US)

(73) Assignee: Zipwall, LLC, Arlington, MA (US)

( * ) Notice: Subject to any disclaimer, the term of this patent is extended or adjusted under 35 U.S.C. 154(b) by 598 days.

(21) Appl. No.: 10/600,300

(22) Filed: Jun. 20, 2003

(65) Prior Publication Data

US 2004/0065799 A1 Apr. 8, 2004

Related U.S. Application Data

(60) Provisional application No. 60/403,681, filed on Aug. 15, 2002.

(51) Int. Cl.
*A47H 13/00* (2006.01)

(52) U.S. Cl. ..... 160/368.1; 248/200.1

(58) Field of Classification Search ..... 248/354.1, 248/200.1, 288.31, 181.1, 181.2; 15/119.2, 15/144.2; 160/368.1, 351, 402, 380, 379
See application file for complete search history.

(56) References Cited

U.S. PATENT DOCUMENTS

| | | | | |
|---|---|---|---|---|
| 827,000 | A | 7/1906 | Dinsmore | |
| 1,177,724 | A * | 4/1916 | Rambo | 248/133 |
| 1,766,324 | A | 6/1930 | Berner | |
| 2,219,169 | A | 10/1940 | Alter | 248/1 |
| 2,232,194 | A | 2/1941 | Zogby | 156/33 |
| 2,474,158 | A | 6/1949 | Neely | 155/180 |
| 2,816,769 | A | 12/1957 | Noble | 279/83 |
| 2,903,227 | A | 9/1959 | de Kalb Key | 248/356 |
| 2,942,829 | A | 6/1960 | Stiffel | 248/193 |
| 3,072,784 | A | 1/1963 | Mann | 240/81 |
| 3,090,826 | A | 5/1963 | Cochran | 174/158 |
| 3,118,363 | A | 1/1964 | Burgess, Jr. | 98/50 |
| 3,247,558 | A | 4/1966 | Kaufman | 24/81 |
| 3,322,381 | A | 5/1967 | Bubb | 248/121 |
| 3,327,310 | A | 6/1967 | Bethune et al. | 343/702 |
| 3,333,808 | A | 8/1967 | Du Boff | 248/354 |
| 3,350,120 | A | 10/1967 | Hinrichs | 287/58 |
| 3,433,510 | A * | 3/1969 | Hulterstrum | 403/77 |
| 3,529,860 | A | 9/1970 | Jelley | 287/189.36 |
| 3,592,434 | A | 7/1971 | Murray | 248/480 |
| 3,604,397 | A | 9/1971 | Salerno | 119/29 |
| 3,608,991 | A | 9/1971 | Wade | 312/345 |
| 3,713,643 | A | 1/1973 | Gerstenberger | 270/61 |
| 3,767,253 | A | 10/1973 | Kluetsch | 296/24 R |

(Continued)

FOREIGN PATENT DOCUMENTS

| | | |
|---|---|---|
| DE | 3918516 | 6/1989 |

(Continued)

*Primary Examiner*—Gwendolyn Baxter
(74) *Attorney, Agent, or Firm*—Mills & Onello LLP

(57) ABSTRACT

A mounting system mitigates or eliminates sags or gaps between an installed curtain and an abutting surface such as a wall or ceiling. The system accomplishes this in a manner that avoids permanent damage to the wall or ceiling surface. A head is provided having an elongated body and a compressible curtain interface. A spring-loaded adjustable pole is configured to urge the head against the curtain and abutting surface. In this manner, the curtain is made to conform to the abutting surface, and gaps are thereby mitigated or eliminated between mounting jacks.

59 Claims, 12 Drawing Sheets

U.S. PATENT DOCUMENTS 3,792,510 A 2/1974 Evett ..... 24/243
3,822,850 A 7/1974 Elias ..... 248/354 S
3,861,663 A 1/1975 Strickland ..... 269/26
3,952,877 A 4/1976 Kindl ..... 211/105.5
3,956,784 A 5/1976 Vargas ..... 5/362
3,972,272 A 8/1976 Bagby ..... 98/50
4,077,083 A * 3/1978 Siemund et al. ..... 15/244.1
4,078,756 A 3/1978 Cross ..... 248/226.4
4,087,006 A 5/1978 Schill ..... 211/86
4,111,217 A 9/1978 Victor ..... 135/15
4,139,101 A 2/1979 Towfigh ..... 211/86
4,277,863 A 7/1981 Faneuf ..... 24/3
4,379,654 A 4/1983 Rovelli ..... 405/53
4,396,325 A 8/1983 Joice-Cavanagh ..... 410/129
4,488,651 A 12/1984 Bishop ..... 211/105.6
4,502,256 A 3/1985 Hahn ..... 52/63
4,536,924 A 8/1985 Willoughby ..... 24/487
4,576,354 A 3/1986 Blessing, Sr. ..... 248/354.5
4,592,797 A 6/1986 Carlson ..... 156/574
4,645,473 A 2/1987 Mochizuki ..... 464/79
4,662,034 A 5/1987 Cunningham ..... 24/90
4,708,189 A 11/1987 Ward ..... 160/351
4,715,089 A 12/1987 Schema ..... 16/115
4,717,107 A 1/1988 Servadio ..... 248/353
4,770,086 A 9/1988 Gabster ..... 98/50
4,794,974 A 1/1989 Melino ..... 160/330
4,824,302 A 4/1989 Schultheis et al. ..... 410/151
4,852,844 A 8/1989 Villaveces ..... 248/314
4,874,028 A 10/1989 Lynch et al. ..... 160/332
4,885,876 A 12/1989 Henke ..... 51/393
4,907,835 A 3/1990 Salters ..... 296/1.1
4,912,814 A 4/1990 McKenzie ..... 24/115
4,926,522 A * 5/1990 Wang ..... 16/427
4,969,241 A 11/1990 Griffin ..... 24/113
5,038,889 A 8/1991 Jankowski ..... 182/129
5,040,915 A 8/1991 Stuart et al. ..... 403/322
5,056,753 A 10/1991 Lunau et al. ..... 248/542
5,078,348 A 1/1992 Babitchenko ..... 248/124
5,116,012 A 5/1992 Offenhauer et al. ..... 248/452
5,129,774 A 7/1992 Balseiro et al. ..... 414/11
5,170,974 A 12/1992 Ruggiero ..... 248/251
5,240,058 A 8/1993 Ward ..... 160/123
5,287,614 A 2/1994 Ehrlich ..... 29/450
5,299,773 A 4/1994 Bertrand ..... 248/514
5,301,915 A 4/1994 Bahniuk et al. ..... 248/452
5,308,280 A 5/1994 Dotson ..... 454/170
5,331,706 A * 7/1994 Graham ..... 15/119.2
5,345,989 A 9/1994 Brophy ..... 160/354
5,375,303 A 12/1994 Shenier ..... 24/163
5,379,491 A 1/1995 Solo ..... 24/3
5,384,938 A 1/1995 Frederick ..... 24/306
5,388,283 A 2/1995 Garnett ..... 4/503
5,404,602 A 4/1995 Kondo ..... 5/504.1
5,469,607 A 11/1995 Henningsson et al. ..... 24/716
5,497,537 A 3/1996 Robinson et al. ..... 24/716
5,524,693 A 6/1996 Hamilton ..... 160/243
5,529,326 A 6/1996 Hwang ..... 280/220
5,536,229 A 7/1996 Albergo ..... 482/148
5,542,209 A 8/1996 Sheu ..... 47/44
5,551,115 A * 9/1996 Newville ..... 15/172
5,555,607 A 9/1996 Parveris ..... 24/129 R
5,558,501 A 9/1996 Wang et al. ..... 416/244
5,584,456 A 12/1996 Stephens ..... 248/214
5,640,826 A 6/1997 Hurilla, Jr. ..... 52/749.14
5,645,272 A 7/1997 Brennan, Sr. ..... 269/69
5,649,780 A 7/1997 Schall ..... 403/109
5,666,702 A 9/1997 Ming-Chieh ..... 24/510
5,673,741 A 10/1997 Cairns ..... 160/330
5,707,032 A 1/1998 Ehrlich ..... 248/205.3
5,715,620 A 2/1998 Walker ..... 40/591
5,722,691 A 3/1998 Patel ..... 281/42
5,803,653 A 9/1998 Zuffetti ..... 403/363
5,884,424 A 3/1999 Smith ..... 40/610
5,897,085 A 4/1999 Cronin ..... 248/200.1
5,924,469 A 7/1999 Whittemore ..... 160/368.1
5,937,488 A 8/1999 Geiger ..... 24/339
5,940,942 A 8/1999 Fong ..... 24/459
5,941,434 A 8/1999 Green ..... 224/250
5,941,586 A 8/1999 Fann ..... 294/19.1
5,979,110 A 11/1999 Tai ..... 47/41.01
6,067,691 A 5/2000 Feltman ..... 24/295
6,152,434 A 11/2000 Gluck ..... 269/6
6,164,605 A 12/2000 Drake et al. ..... 248/74.3
6,170,112 B1 * 1/2001 Mayfield et al. ..... 15/159.1
6,209,615 B1 4/2001 Whittemore ..... 160/368.1
6,341,401 B1 * 1/2002 Lin ..... 15/119.2
6,378,175 B1 4/2002 Vanderpan ..... 24/336
6,467,741 B1 10/2002 Shih ..... 248/200.1
6,474,609 B1 11/2002 Pinard ..... 248/303
6,490,749 B1 * 12/2002 Morad ..... 15/145
6,508,295 B2 1/2003 Whittemore ..... 160/368.1
6,523,231 B1 2/2003 Lassiter ..... 24/339
6,718,589 B2 * 4/2004 Kimbro ..... 15/159.1
2001/0029640 A1 10/2001 Cassar ..... 15/144.1
2003/0154588 A1 8/2003 Blacket et al. ..... 29/456

FOREIGN PATENT DOCUMENTS

DE 4420849 12/1995
DE 29605222 7/1996
FR 2411282 6/1979
GB 1042086 9/1966
GB 2 156 894 10/1985
WO WO 86/03538 6/1986
WO WO 91/09556 7/1991
WO 9427480 12/1994

* cited by examiner

PARTITION MOUNT WITH EXTENDED-LENGTH HEAD

RELATED APPLICATIONS

This application claims the benefit of the filing date of U.S. Provisional Patent Application Ser. No. 60/403,681, filed Aug. 15, 2002.

BACKGROUND OF THE INVENTION

Partition systems are often employed to isolate portions of a building or room, by serving as a barrier to dust, noise, light, odors, and the like. In construction zones, partitions are useful for protecting a clean area from a work area, for example, protecting an area where furniture and rugs are temporarily stored from an area where wood floors are being refinished.

Workers at construction sites often use rudimentary techniques for installing partitions. Some simply nail, screw, or staple the curtain or partition material to the floor, ceiling, and abutting walls, resulting in damage to their surfaces. Others tape, or otherwise adhere, a curtain or plastic sheet to the walls and ceilings. The tape usually fails to stick, but if it does stick, as the tape is removed, paint can pull off with the tape, or adhesive is left behind.

U.S. Pat. No. 5,924,469, the content of which is incorporated herein by reference, discloses a partition mount system that addresses these limitations. This system offers the advantage of accommodating standard extension poles, for example, painters poles, with standard threads, and is compatible with a variety of commercially-available curtain or drape materials, for example plastic, cloth, and the like. The disclosed system is a "clean" system designed to be installed and removed without damaging or otherwise marking the ceiling, floor or walls in the construction zone. Assembly is easy and fast and can be accomplished by a single individual. In certain applications however, a sag, or gap, may be present in the curtain between installed mounting jacks along a-ceiling, or between the ceiling and floor along a wall or door frame, compromising the effectiveness of the installation.

SUMMARY OF THE INVENTION

The present invention is directed to a system that mitigates or eliminates sag, or gaps, between an installed curtain and an abutting surface such as a wall or ceiling. The system accomplishes this in a manner that avoids permanent damage to the wall or ceiling surface. A head is provided having an elongated body and a compressible curtain interface. An adjustable pole is configured to urge the head against the curtain and abutting surface. In one example, the pole is spring-loaded. In this manner, the curtain is made to conform to the abutting surface, and gaps are thereby mitigated or eliminated between mounting jacks, or between a mounting jack and another mounting point.

In one aspect, the present invention is directed to a mounting system. The system comprises an elongated body having a longitudinal axis. A curtain interface, for example a pad, is coupled to an upper surface of the body. A coupler includes an interface for receiving a mounting member, the position of the coupler being adjustable relative to the longitudinal axis of the body.

The pad may comprise any of a number of materials, for example, foam, polyurethane foam, extruded vinyl, rubber strips, and the like. The pad may be freely compressible, or non-compressible. A non-skid pad material is preferred to avoid slippage.

The body may take the form of an extruded rail, for example including a U-shaped slot, wherein the pad is mounted in the slot. Any of a number of various forms of rail and pad are applicable.

The coupler is preferably removably mountable to the body. The coupler may include, for example, quick-release arms that engage a feature on the body for removably mounting the coupler to the body. The position of the coupler relative to the body can be adjusted variably, or can be determined according to indexed positions on the body.

The mounting member preferably comprises a mounting pole, in which case, the coupler includes a socket for receiving a ball joint of a mounting pole. The body is for example rotatable relative to the mounted pole. The coupler further includes an optional retainer for preventing lateral rotation of the body relative to the mounting pole. The ball joint of the mounting pole further includes an optional flange having a flat surface for interfacing with the retainers for preventing horizontal pivot of the body about the mounting pole. The pole is preferably adjustable in length, and may include an optional compression mechanism to allow for compression along a longitudinal axis thereof.

The length of the body is preferably substantially greater than the width of the body, for example the length of the body is at least 1 ft in length.

In another aspect, the present invention is directed to a mounting system. The system includes a pole and an elongated body having a longitudinal axis. A pad is coupled to an upper surface of the body. A coupler rotatably couples the pole to the body.

In a preferred embodiment, the coupler rotatably couples the pole to the body such that the longitudinal axis of pole is parallel to, or lies in, a rotational plane of the longitudinal axis of the body. In another embodiment, the coupler removably couples the pole to the body.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
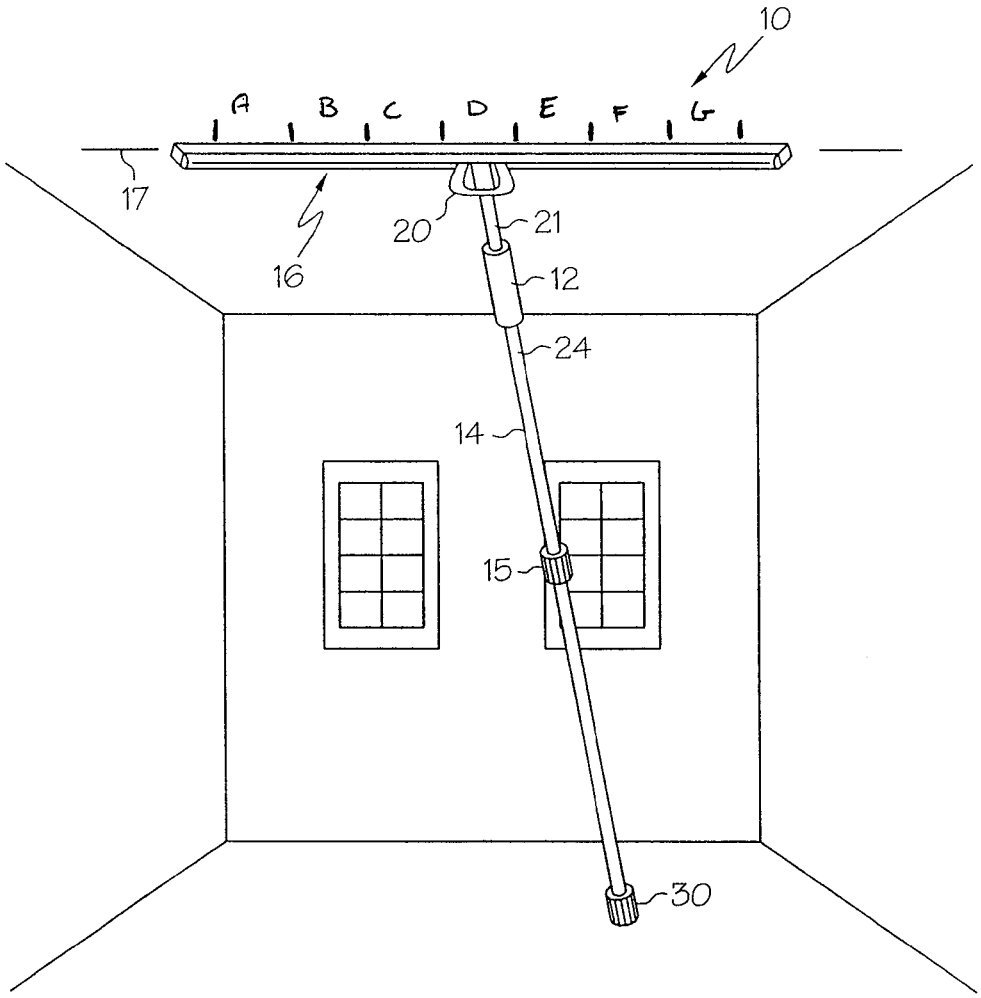
FIG. 1 is a perspective view of an installed partition mount having an extended head, in accordance with the present invention.

FIG. 1 is a perspective view of an installed partition mount 10 having an extended head, in accordance with the present invention. A spring-loaded jack curtain mount, referred to herein as a "jack" 12, attaches to an adjustable-length pole 14 at a first interface 24. In one example, the first interface 24 is threaded so as to accommodate a standard painter's pole 14. A second interface in the form of a coupler 20 is opposite the first interface 24, and is positioned on a neck 21 that travels with respect to the jack body, biased by an enclosed compression spring (not shown). Other forms of jacks, poles, and compression mechanisms, for example those disclosed in U.S. Pat. No. 5,924,469 incorporated herein by reference above, are equally applicable to the present invention.

An elongated head 16 attaches to the jack 12 at the coupler 20. A pivot in the coupler 20 permits rotational movement of the head 16, relative to the pole 14 and jack 12, for example in a single degree of freedom of rotation, that is, for example, parallel to the longitudinal axis 17 of the head 16. The coupler 20 allows for the partition mount 10 to be installed in a variety of configurations, for example in a configuration where the ceiling and floor are not parallel. In various embodiments, the coupler 20 may comprise a hinge, or preferably, a snap-fit ball-and-socket joint that is, for example, limited in rotational degrees of freedom to allow for pivoting between the elongated head 16 with respect to the pole 14 and jack 12, and to limit lateral rotation. The, coupler 20 may be located at any position along the longitudinal axis 17 of the head 16, and may be in a fixed longitudinal position, or alternatively, in a variable longitudinal position that can be set by a user during installation. Alternatively, multiple poles 14 and jacks 12 may be mounted at various positions along a common head 16, for example at the opposite ends of the head 16, in order to avoid placing the poles 14 supporting the head 16 in a central position of a doorway.

Figure 2:
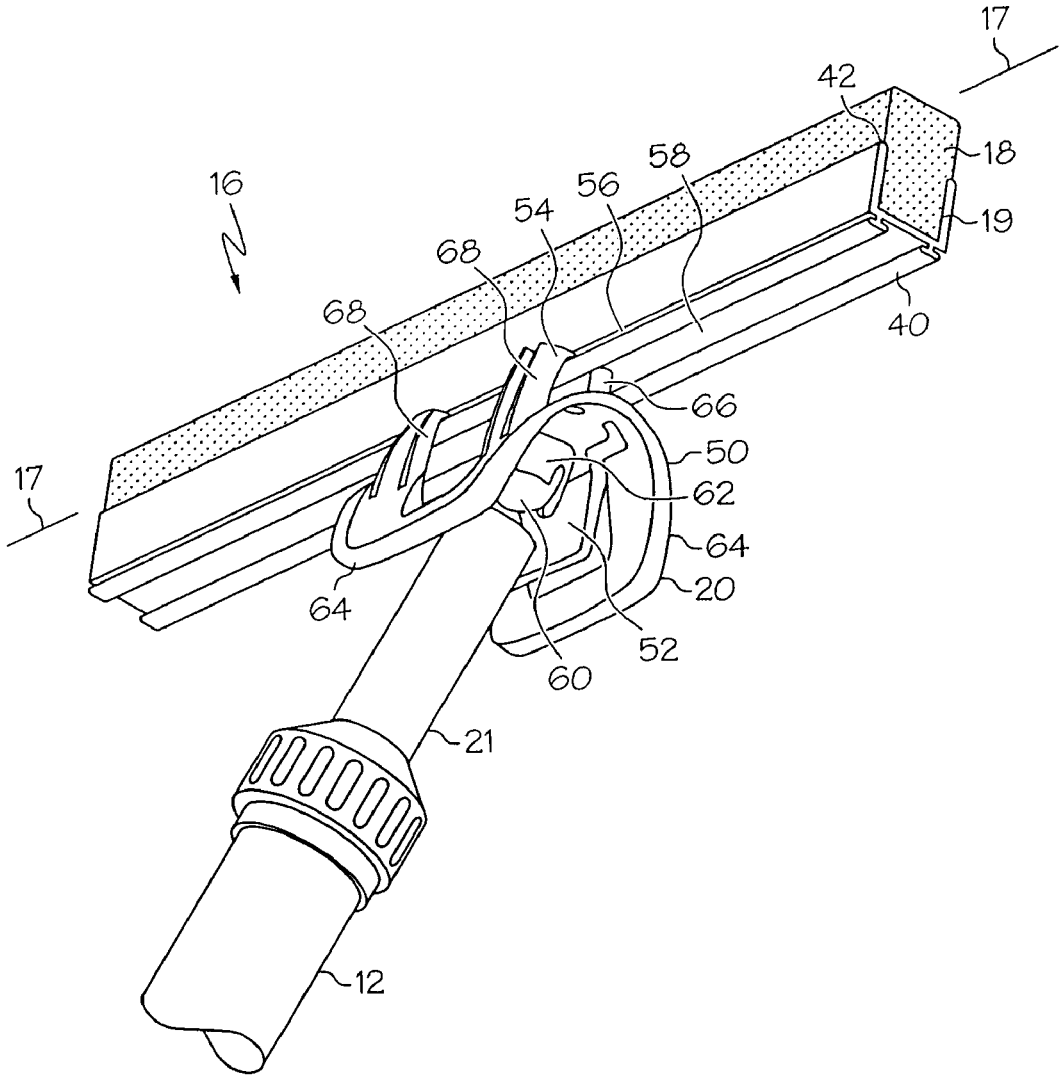
FIG. 2 is a close-up perspective view of the partition mount of FIG. 1 in accordance with the present invention.

With reference to FIG. 2, which is a close-up perspective view of the partition mount of FIG. 1, in one embodiment, the elongated head 16 comprises a rail body 40 generally having a U-shaped cross-section, the rail including a channel 19 that is shaped to receive an edge of a compressible pad, for example in the form of a foam block 18. The rail may be formed, for example, of extruded aluminum, or may otherwise be molded or die cast, for example of plastic, PVC, graphite or other resilient material. The foam block 18 is rectangular in shape and extends over the length of the head 16. The foam block 18 may be compressed and seated into the channel 19, or may otherwise be glued or bonded to the rail 40. A portion of the body of the foam block 18 extends from the outer edge 42 of the rail 40 as shown, such that the foam compresses at installation to provide for lateral rigidity and conformance between the head, curtain and installation surface. The foam block 42 is preferably formed of a non-skid material to prevent slippage.

In alternative embodiments, rather than having a U-shaped cross-section, the head 16 may comprise a rail 40 having a flat upper surface, and the compressible material (for example, the foam block 18) may be bonded directly to the upper surface of the flat rail 40. Alternatively, the head 16 may be formed of a material that is substantially laterally rigid, so as to avoid flex, and compressible in the direction of the ceiling, or entirely rigid, depending on anticipated use. In one embodiment, the head 16 is of a length that is substantially longer than a width thereof, for example, the length is on the order of 2-4 feet, and the width is on the order of 1-2 inches. Other geometries are equally applicable, depending on system requirements.

The spring-loaded jack 12 is coupled to the longitudinally extended head 16 at coupler 20. The coupler 20 has a "U"-shaped cross section and includes mounting arms 68 with retention tabs 54 at its base, a socket 62 at a central location of the body 50, neck retainers 52 along side portions of the body 50 and handles 64 at upper portions of the body 50. The socket 62 receives a ball 60 provided at the end of neck 21 of the jack 12. The ball 60 and socket 62 are preferably in a snap-fit relationship and together form a universal joint for allowing rotation of the head 16 relative to the jack 12 and pole. The socket is preferably of a geometry so as to receive a ball of the type described in U. S. Pat. No. 5,924,469, such that the head 16 of the present invention is compatible with the mounting jack described therein. The neck retainers 52 limit the rotation on the universal joint to one degree of freedom, for example along a plane defined between the longitudinal axis 17 of the head 16 and the pole and jack 12. The coupler 20 further includes a pin 66 along its base, which is adapted to slide within a central groove 58 of the rail 40 to provide for additional system rigidity and to serve as a mounting alignment locator.

The "U"-shaped coupler 20 includes opposed handles 64. When inward pressure is exerted on the handles 64, this causes the body of the coupler 20 to elastically deform. This, in turn, causes outward movement of the legs, or mounting arms 68, and retention tabs 54. When the pressure is released, the tabs 54 return to their original position. In this manner, the coupler can be mounted to, and released from, the body 40 of the head 16.

The head 16 includes an elongated rail 40 and a compressible pad 18, for example a foam block. The rail 40 may comprise, for example, an extruded member formed of plastic, aluminum, or alloy, and having a "U"-shaped profile as shown. The pad 18 is mounted in cavity 19 of the rail 40, and may be press-fit, or otherwise bonded in place. The pad 18, is, for example, rectangular in shape and may be formed of low-density foam or rubber, having a certain degree of compressibility so as to conform to an abutting surface, while still exhibiting resiliency and shape memory. The rail 40 further includes a horizontal groove 56 on each outer side surface for interfacing with the retention tabs 54 on the arms 68 of the coupler 20, and central slot 58, for interfacing with the pin 66 on the body of the coupler 20.

Figure 3:
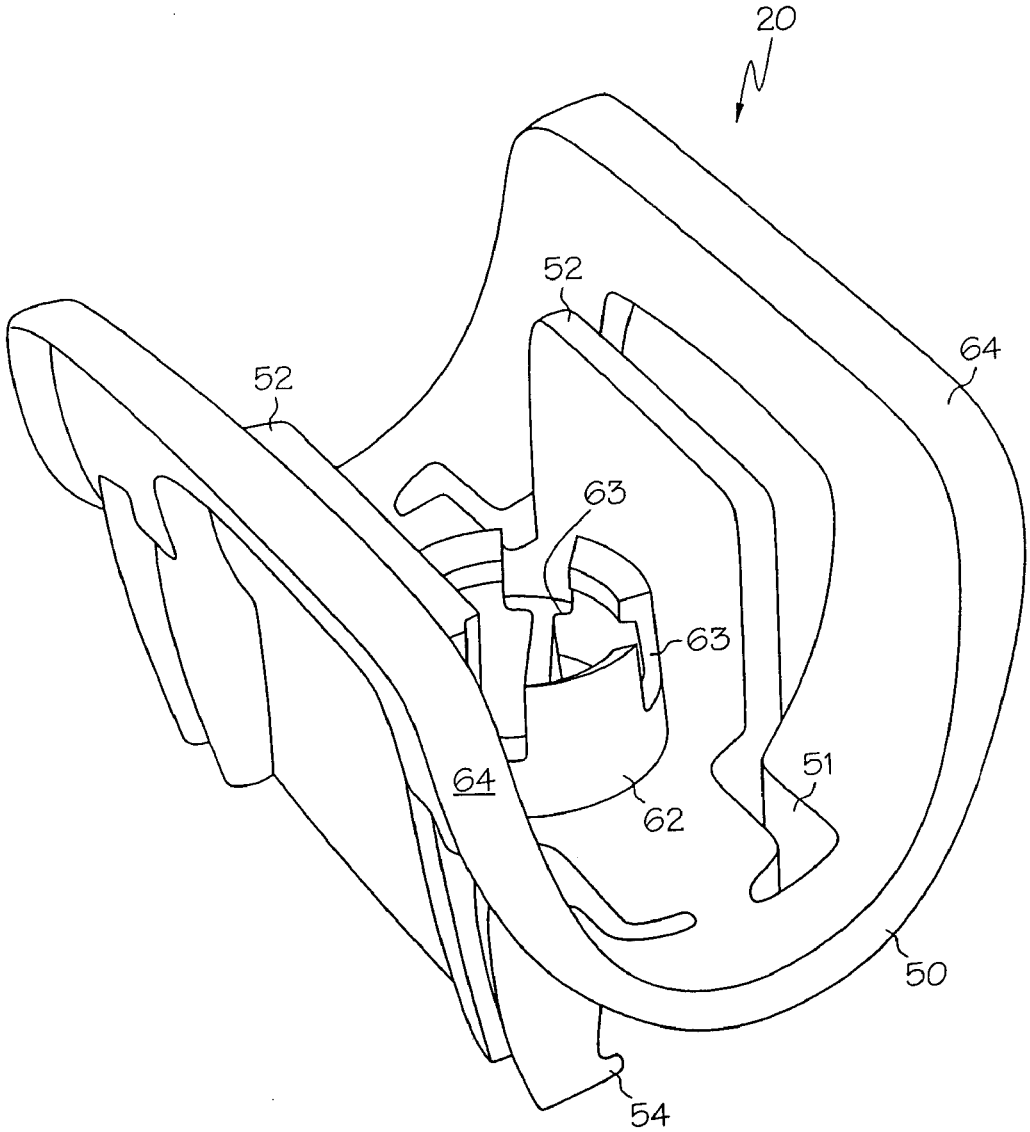
FIG. 3 is a close-up perspective view of a head coupler in accordance with the present invention.

FIG. 3 is a close-up perspective view of a head coupler 20 in accordance with the present invention. In this view, it can be seen that the socket 62 includes voids, or slots 63, which allow for elastic expansion of the socket 62 about an inserted ball. In addition, the lower portion of the body 50 includes elasticity grooves 51, for improving the elasticity of the body 50 to allow for ease in deformation when mounting the body to a head. The geometry of the neck retainers 52 is also visible in this view. The neck retainers 52 are preferably spaced apart a suitable distance so as to retain the neck to prevent lateral rotation of the neck about the head and to permit free longitudinal rotation of the neck about the head. Other geometries of the head coupler and its various components and features are equally applicable to the present invention.

Figure 4C:
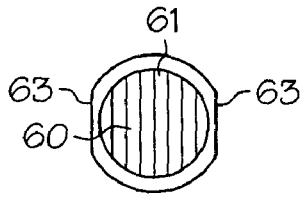
FIG. 4C is a top view of the ball and neck assembly, including a flange having flat edges for limiting lateral rotation of the head about the ball, in accordance with the present invention.
Figure 4A:
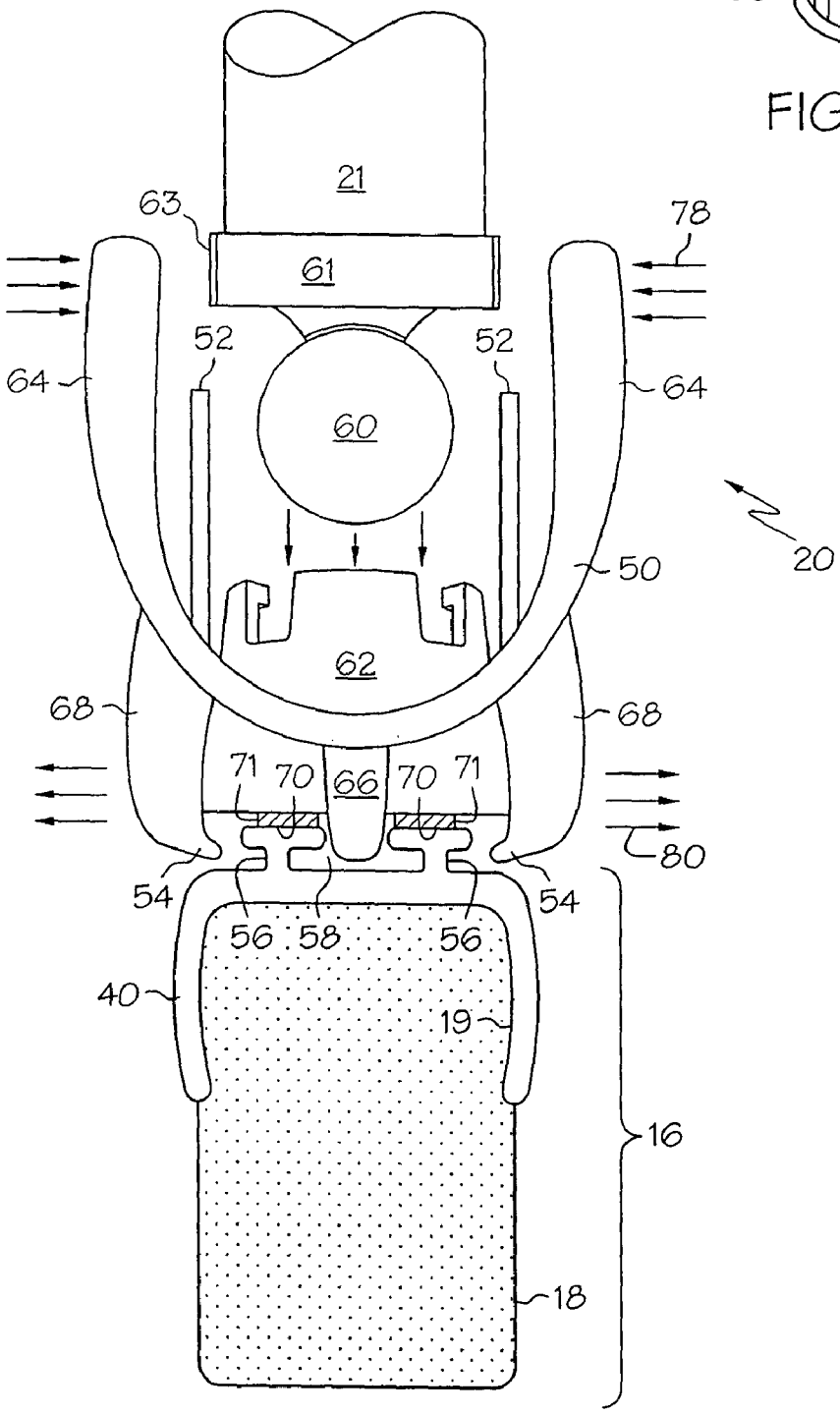
FIGS. 4A and 4B are side views of the head coupler being coupled to a head, in accordance with the present invention.
Figure 4B:
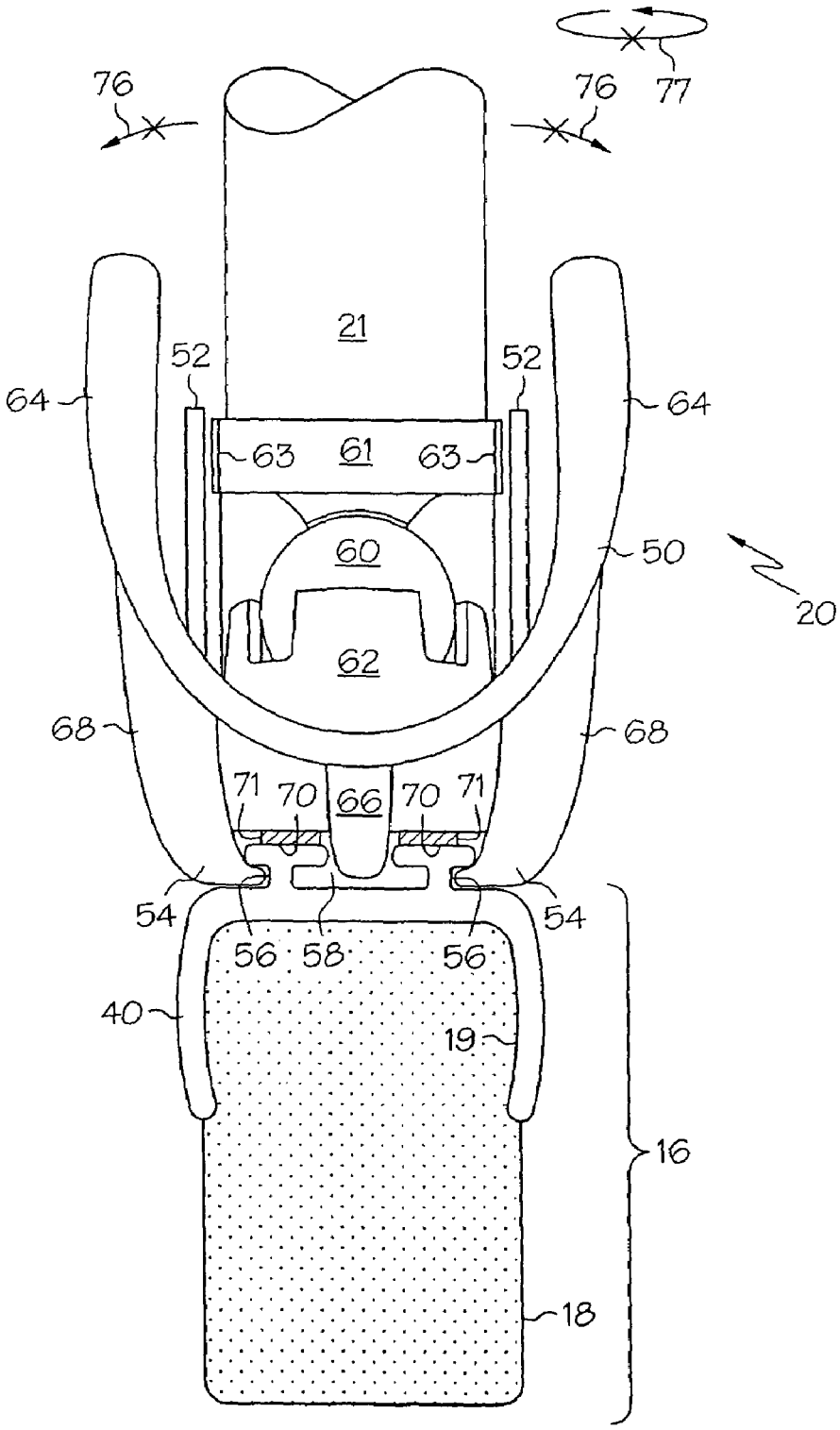

FIGS. 4A and 4B are side views of the coupler 20 being coupled to a head 16, in accordance with the present invention. In FIG. 4A, a neck 21 and ball 60 of the jack assembly are pushed into the socket 62 of the coupler. With reference to FIG. 4B, once inserted, the ball 60 is press-fit into the socket 62, while neck retainers 52, extending from the body 50 prevent motion in the lateral direction, as indicated by arrows 76. In addition, with reference to the top view of the ball 60 and neck 21 assembly of FIG. 4C, the neck can be provided with a flange 61 having flat edge features 63 as shown. The flat edges 63 of the flange 61 are configured such that, when the ball is mounted into the socket, as shown in FIG. 4B, the flat edges 63 interface with the inner surfaces of the neck retainers 52, thereby preventing horizontal pivot of the head 16 assembly about the neck 21, as indicated by arrow 77. In this manner, greater control over the positioning of the head can be realized during mounting.

Returning to FIG. 4A, when inward pressure, as shown by arrows 78 is applied to the handles 64 of the coupler 20, the body 50 of the coupler flexes and the arms 68 move in an outward direction, as indicated by arrows 80. Outward movement of the arms 68 in turn causes the retention tabs 54 to deflect outwardly as shown, such that the tabs 54 can be positioned in the opposed horizontal grooves 56 of the rail 40. Coupler pin 66 is aligned with the central slot 58 of the rail 40 to serve as a mounting guide. In addition, the coupler pin provides a point for leverage when mounting and removing the coupler 20, ensuring that when force is applied to the handles, both sets of tabs are released at the, same time from the rail.

As shown in FIG. 4B, when the inward pressure 78 is released, the retention tabs 54 are fixed in the horizontal slots 56, and bear on an upper portion thereof At the same time, the lower surface of the body of the coupler 20 bears down on an upper surface 70 of the body of the rail 40. Non-skid material, for example, in the form of rubber plugs 71 inserted into the lower surface of the coupler 20 body, further provide for a secure fit between the coupler 20 and rail 40, for example preventing slip of the coupler 20 in a longitudinal direction of the rail 40. The interaction of the retention tabs 54 and the lower surface of the coupler 20, along with the non-skid material 71, secures the coupler 20 to the head 16.

In one embodiment, the present invention further allows for positioning of the coupler 20 at a plurality of locations along the length of the rail 40 of the head 16. In the example given above, a suitable amount of inward pressure can be exerted on the handles 64 of the coupler 20 to cause the inward force of the retention tabs 54 to be released slightly. With the retention tabs 54 still interfacing with the rail groove 56, and with the pin 66 still interfacing with the central slot 58, when the retention tabs 54 are released slightly, the coupler 20 slides freely along the rail 40 of the head 16. In this manner, the coupler 20 can be positioned at any desired location along the rail 40. This feature further allows for a plurality of pole and jack assemblies to be mounted to a common head 16. In an alternative embodiment, the positioning of the interface of the coupler 20 and head 16 can be at fixed, indexed positions along the rail 40, for example, spaced apart by a fixed distance, for example indexed positions A-G as shown in FIG. 1.

Figure 5:
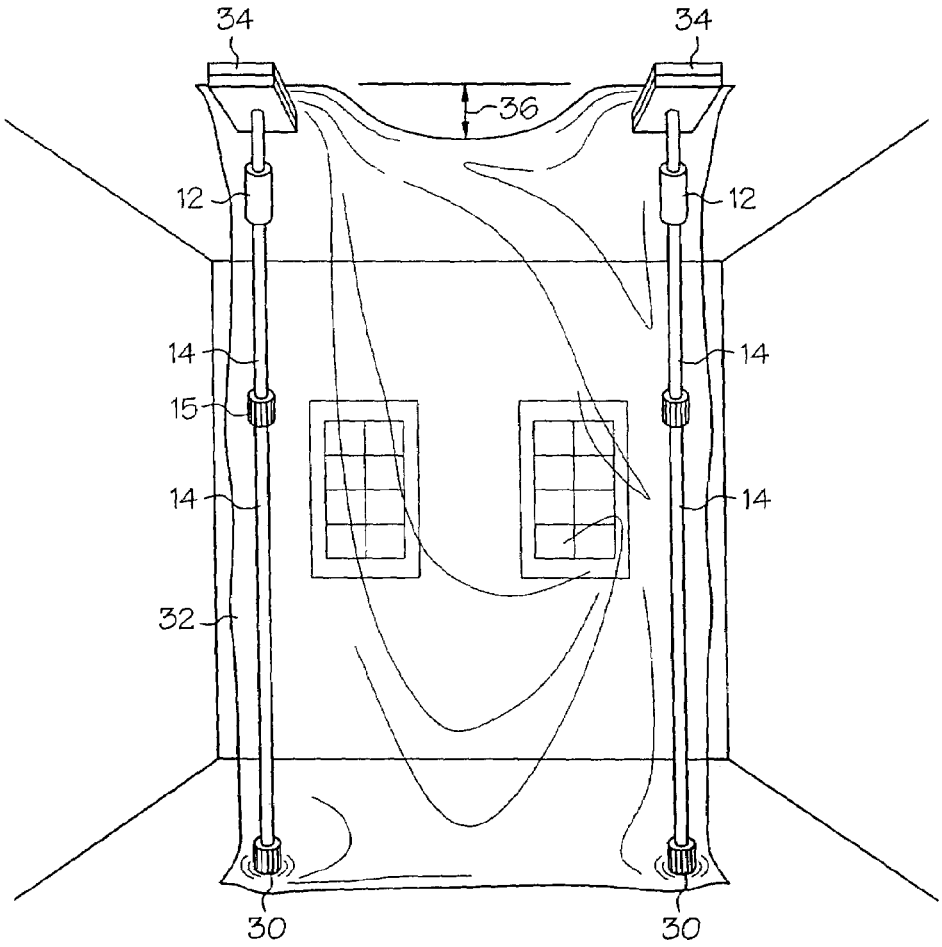
FIG. 5 is a perspective view of an installed curtain, illustrating sag in the curtain between partition mounts.

FIG. 5 is a perspective view of an installed curtain, illustrating sag in the curtain between partition mounts. A curtain 32 is secured to first and second mounting jacks 12 and poles 14, for example of the type disclosed in U.S. Pat. No. 5,924,469. The top edge of the curtain 32 is attached to the heads 34 of the jacks 12, and the poles 14 are adjusted in length at adjustment mechanism 15 so as to be rigid between the floor and ceiling, and such that the head 34 and foot 30 are outwardly biased by the spring within the jack 12. Outward tension in the curtain 32 is created by moving the heads 34 apart from each other, and, ideally, the curtain 32 remains tensioned between them.

However, due to a variety of factors, including slippage between the jack heads 34 and ceiling, slippage between the curtain 32 and jack heads 34, stretch in the curtain 32 material, or movement of the foot 30 and curtain relative to the floor, or a combination of all of these factors, tension along the upper edge of the curtain, where the curtain interfaces with the ceiling, may be immediately, or eventually diminished, in which case a curtain sag may result, leaving a gap as indicated by arrow 36. Such a gap may be undesirable in many applications.

Figure 6:
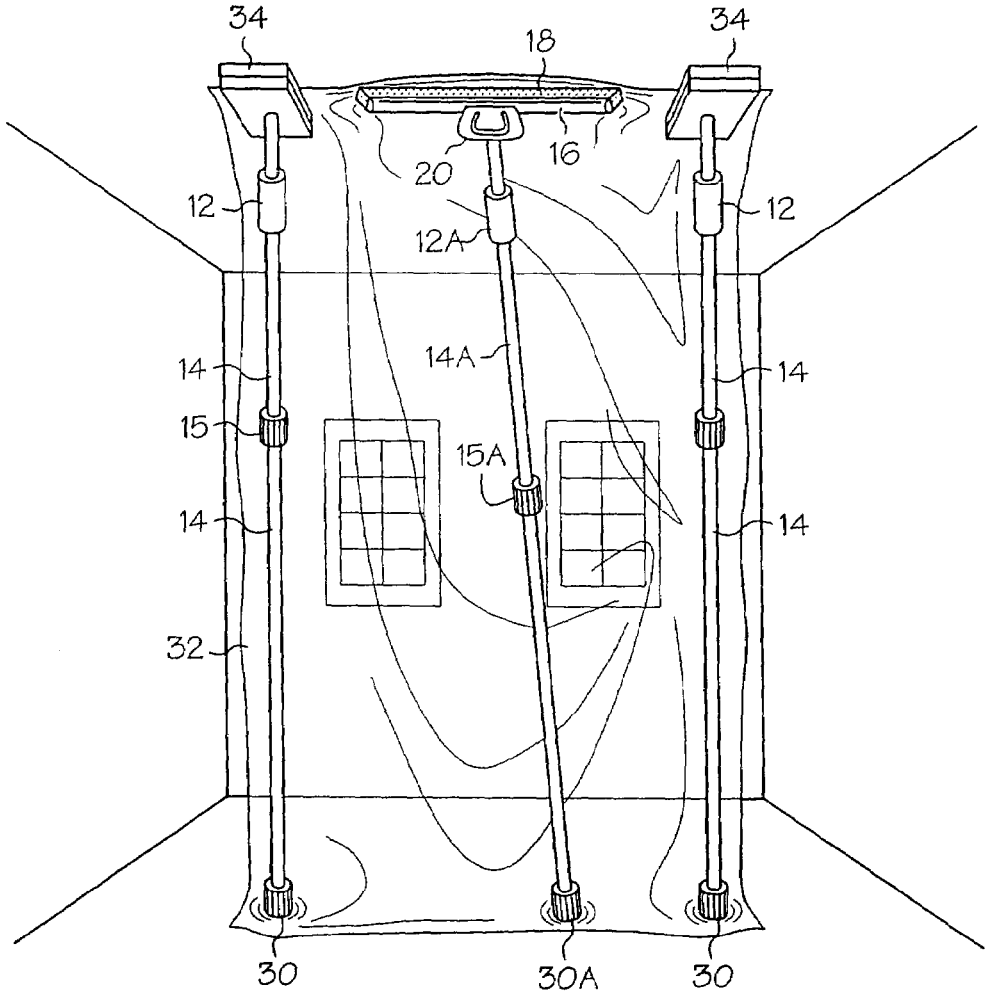
FIG. 6 is a perspective view of an installed curtain, including an extended-head mount mitigating sag in the curtain along the ceiling in accordance with the present invention.

Turning to FIG. 6, an extended-head mount, in accordance with the present invention, can be used to mitigate or eliminate the effects of curtain sag. The head 16 is mounted to pole 14A at spring-loaded jack 12A. The spring, or other compression mechanism, serves to outwardly bias the pole and head with respect to each other, such that upon adjustment of the length of the pole 14A at adjustment mechanism 15A, the foot 30A can be made to interface with the lower portion of the curtain 32 at the floor, and the head 16 can be made to interface with the upper portion of the curtain 32 at the ceiling. The upper portion of the foam pad 18 of the head is in contact with the underside of the curtain 32, and serves to urge the curtain 32 against the ceiling. The foam block 18 of the head has a certain degree of give and therefore conforms to the abutting surface.

Figure 7:
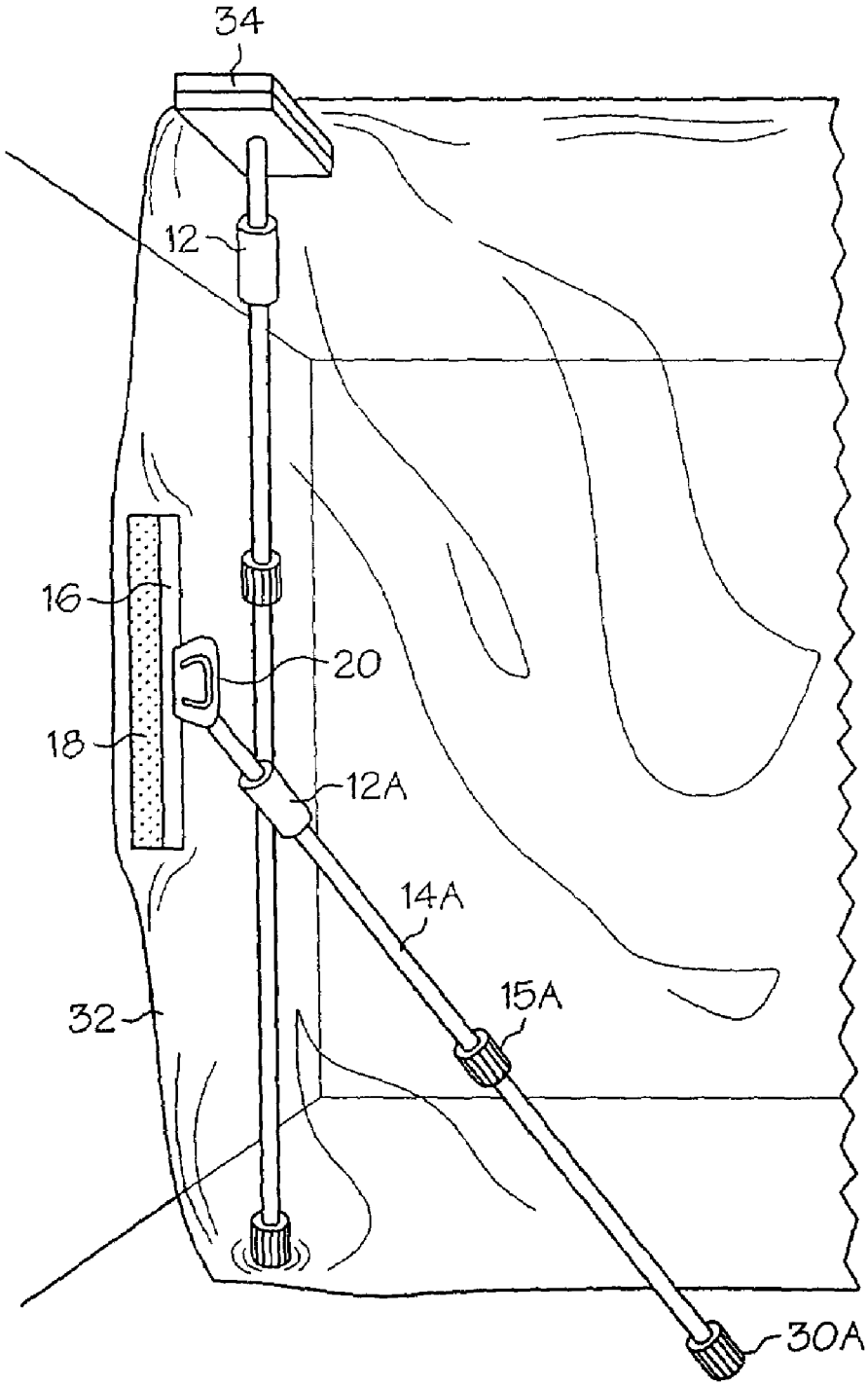
FIG. 7 is a perspective view of an installed curtain, including an extended-head mount mitigating sag in the curtail along a wall in accordance with the present invention.

FIG. 7 is a perspective view of an installed curtain, including an extended-head mount, mitigating sag or gaps in the curtain along a wall. In this configuration, the pole length is adjusted at adjustment mechanism 15A so as to compress the foot 30A and head 16 between the floor and wall respectively. The body of the head 16, with foam insert 18, serves to urge the curtain against the wall, under the tension of the compression of the spring in the jack 12A.

Figure 8:
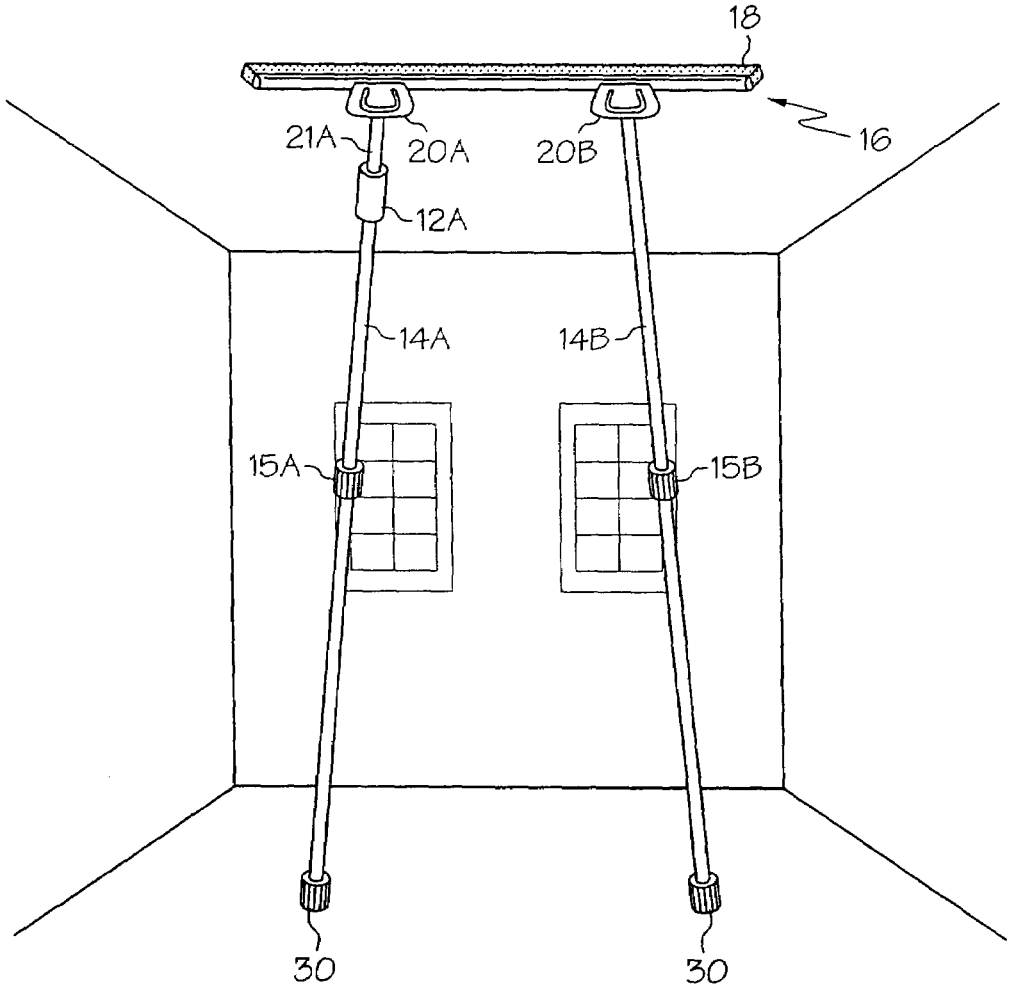
FIG. 8 is a perspective view of an installed partition mount having an extended head that utilizes a plurality of supporting poles, in accordance with the present invention.

FIG. 8 is a perspective view of an installed partition mount having an extended head that utilizes a plurality of supporting poles, in accordance with the present invention. In this example, first and second mounting poles 14A, 14B are both coupled to a common mounting head 16. In this example, the first pole 14A includes a jack assembly 12A as described above, and the second pole 14B, for the purpose of example, does not include such a spring-loaded jack. Instead, a ball 60 and flange 61 are mounted directly to an upper portion of the pole 14B, and the compressibility of the pad 18 in the neck provides sufficient give, such that tension can be applied along the pole 14B between the foot 30 and head 16, via coupler 20B upon proper adjustment of the length of the pole. Alternatively, for example, a longitudinal compression mechanism, for example a spring, may be integrated into the adjustable-length pole 14B. This embodiment is especially useful for applications requiring a central opening, such as a doorway, or in applications where an especially long mounting head is desired, and the amount of support available from a single pole and jack is insufficient.

While this invention has been particularly shown and described with references to preferred embodiments thereof, it will be understood by those skilled in the art that various changes in form and details may be made herein without departing from the spirit and scope of the invention as defined by the appended claims.

Figure 9B:
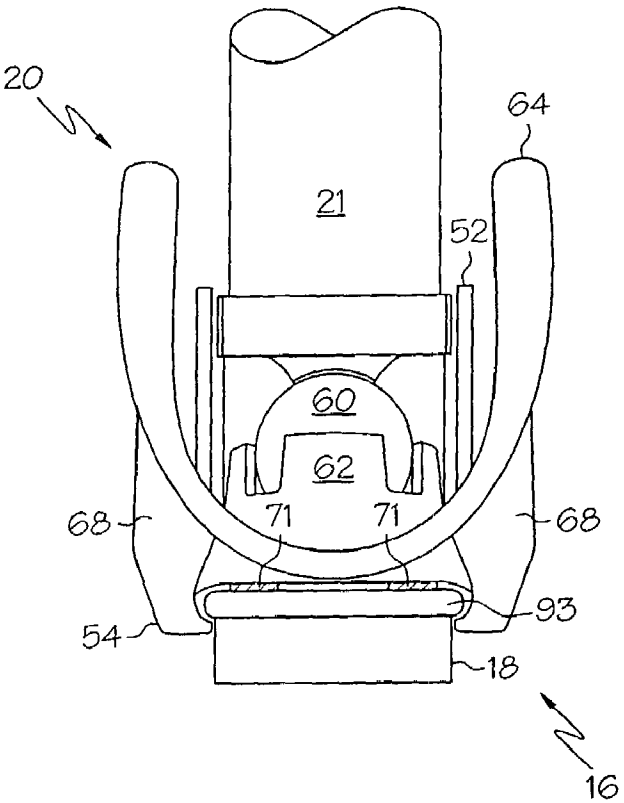
FIGS. 9A and 9B are side views of alternative embodiments of the head coupler and head interface, in accordance with the present invention.
Figure 9A:
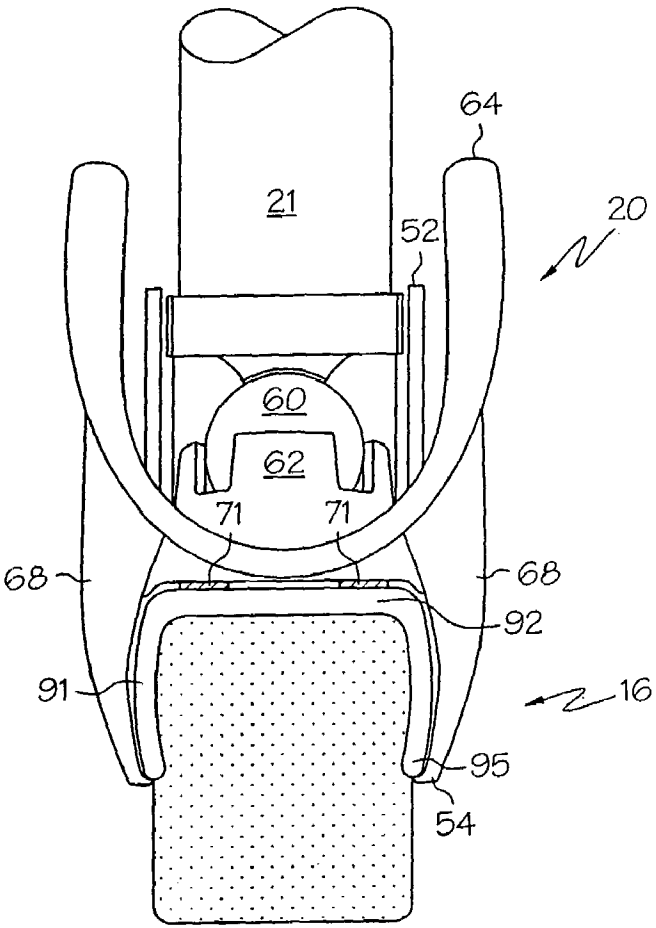

For example, with reference to FIGS. 9A and 9B, side views of alternative embodiments of the coupler and head interface are illustrated. In the example of FIG. 9A, the head includes a U-shaped rail 91 having a flat upper portion 92. The arms 68 of the coupler 20 in this example extend to the lower edge 95 of the rail 91, where retention tabs 54 grasp and retain the edge 95. Non-skid pads 71 may be provided at the interface of the head 16 and coupler 20, as described above. In the example of FIG. 9B, the head includes a flat rail 93, and a flat pad 18 is attached to the bottom surface of the flat rail 93. The arms 68 of the coupler 20 in this example include retention tabs that reach about the body of, and secure, the rail 93. Non-skid pads 71 may be provided, as described above.

Figure 10A:
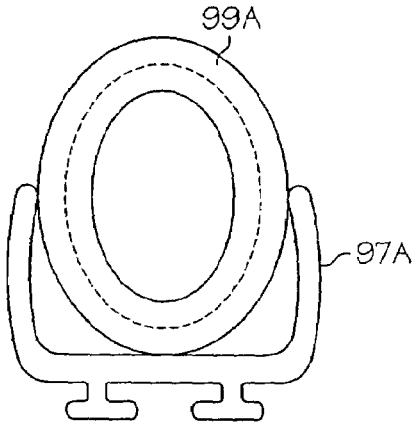
FIGS. 10A, 10B, 10C, and 10D are side views of alternative embodiments of the head pad, in accordance with the present invention.
Figure 10B:
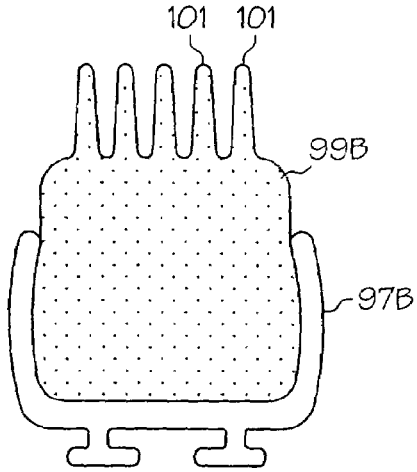
Figure 10C:
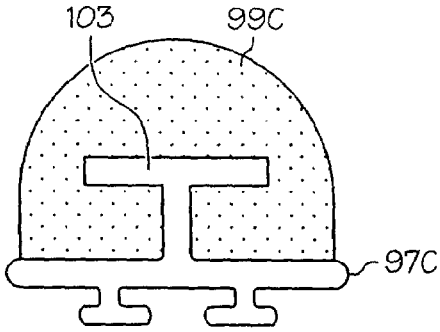
Figure 10D:
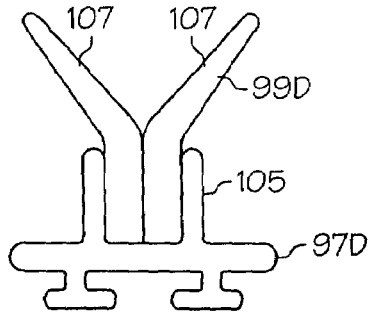

In another example, FIGS. 10A, 10B, 10C, and 10D are side views of alternative embodiments of the curtain interface, in accordance with the present invention. In the example of FIG. 10A, the head rail 97A is U-shaped, and a tubular head pad 99A formed, for example, of extruded vinyl, is press fit and optionally bonded into the rail cavity. The hollow shape of the head pad 99A provides compressibility when mounted. In the example of FIG. 10B, the head rail 97B is U-shaped, and a head pad 99B, for example formed of hard rubber, is press fit and optionally bonded into the rail cavity. In this example, the head pad 99B includes a plurality of fingers 101 that extend from the body of the pad as shown. Compressibility in the pad 99B is achieved through the flexibility in the fingers 101. In the example of FIG. 10C, the head rail 97C is flat, with a T-shaped retainer 103 extending from the base. A compressible foam, rubber, or vinyl pad 99C is formed on, or applied to, the rail 97C, held in place by the retainer 103. In the example of FIG. 10D, the head rail 97D, is flat with a U-shaped retainer 105 extending from the base. A compressible foam, rubber, or vinyl pad 99D is inserted in the retainer 105. In this example, the head pad 99D includes a plurality of fingers 107 that extend from the body of the pad as shown. Compressibility in the pad 99D is achieved through the flexibility in the fingers 107.

Figure 11:
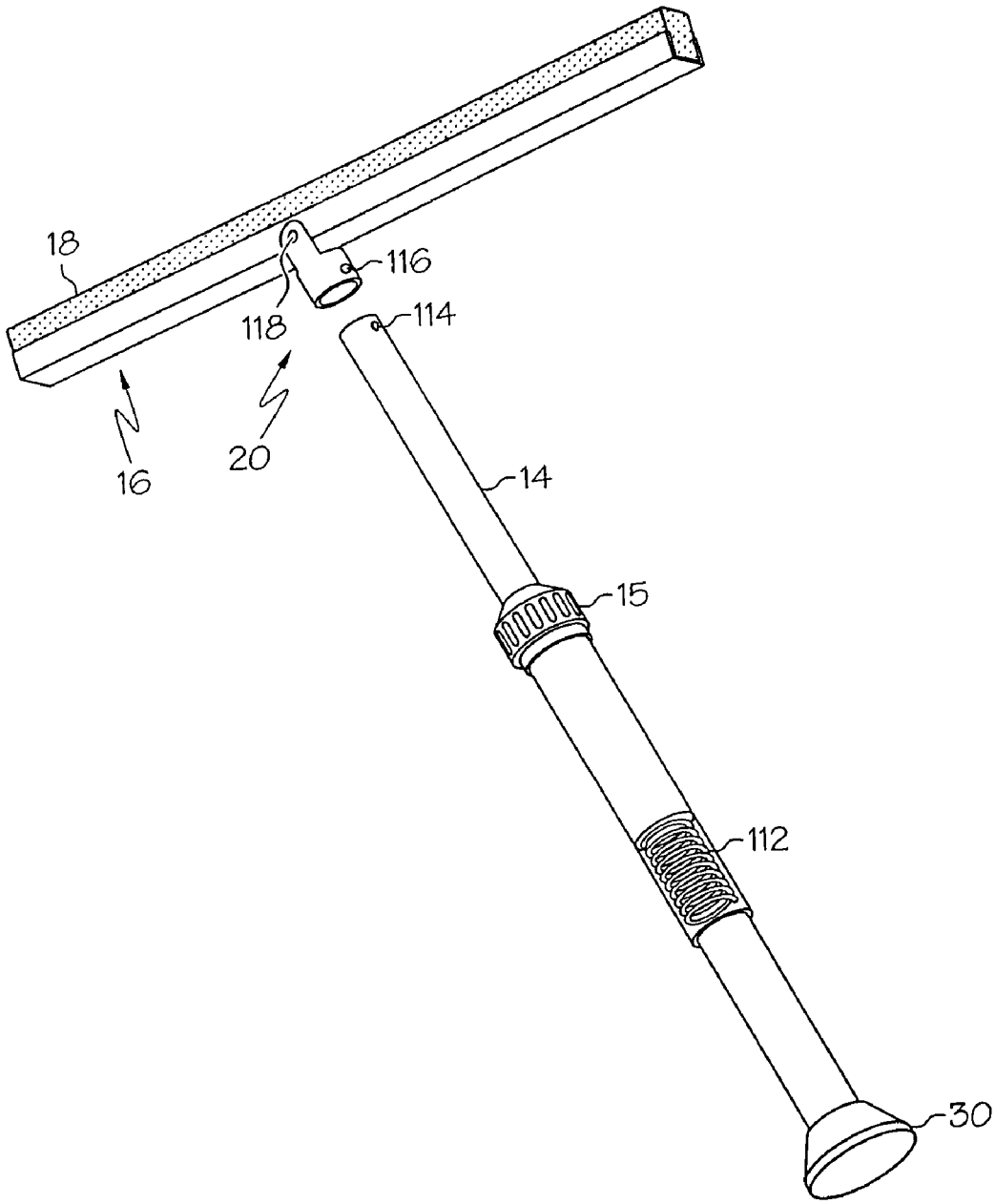
FIG. 11 is a perspective view of an alternative embodiment of the partition mount, in accordance with the present invention.

In other alternative embodiments, the interface of the pole and head may comprise a fixed, non-rotating joint. Alternatively, as shown in FIG. 11, the head coupler 20, for coupling the head 16 and pole 14, may be at a fixed position on the head. In an embodiment that permits rotation of the head relative to the pole, a one-degree-of-rotation joint, for example a hinge 118 or axle, may be used to couple the pole 14 and head 16. In addition, the interface between the pole 14 and the coupler may comprise any of a number of suitable configurations, including, for example, a male/female threaded interface, or a slip-fit interface whereby the pole and coupler mate with each other, with a push-button 114 and corresponding hole 116 for securing the coupler 20 and/or head 16 to the pole 14. A spring 112 may be integrated directly into the pole 14, as shown. The pole 14 may include an adjustment mechanism 15 for adjusting the length, as described above.

We claim:

1. A mount comprising:

an elongated body having a longitudinal axis;

a curtain interface positioned at a top surface of the body;

a coupler adapted for coupling the elongated body to a mounting member, the mounting member having a longitudinal axis, the coupler including an interface adapted to receive the mounting member, a coupling position of the coupler being adjustable over a range of positions relative to the longitudinal axis of the body, the coupler including a guide mechanism that limits rotation of the body relative to the mounting member to a single degree of rotation, permitting the longitudinal axis of the body to rotate relative to the mounting member in a common rotational plane; and the mounting member comprising an adjustable-length pole, the body being rotatable relative to the mounting member, the mounting member including a compression mechanism along the longitudinal axis thereof, the mounting member being of a sufficient length to be fixed between a first surface of a room and a second surface of the room, the compression mechanism configured to urge the curtain interface toward one of the first surface and the second surface of the room when under compression between the first and second surfaces of the room to retain the mounting member and body in a fixed position relative to the first and second surfaces of the room.

2. The mount of claim 1 wherein the curtain interface comprises a compressible material.

3. The mount of claim 2 wherein the compressible material is one selected from the group of materials consisting of foam, polyurethane foam, extruded vinyl, and rubber strips.

4. The mount of claim 1 wherein the body comprises a rail.

5. The mount of claim 4 wherein the rail includes a U-shaped slot and wherein the curtain interface is mounted in the slot.

6. The mount of claim 4 wherein the rail comprises an extrusion.

7. The mount of claim 1 wherein the coupler is removably mountable to the body.

8. The mount of claim 7 wherein the coupler further includes quick-release arms that engage a feature on the body for removably mounting the coupler to the body.

9. The mount of claim 1 wherein the position of the coupler on the body can be adjusted variably.

10. The mount of claim 1 wherein the position of the coupler is determined according to indexed positions on the body.

11. The mount of claim 1 wherein the interface of the coupler is adapted to receive the mounting member.

12. The mount of claim 11 wherein the coupler includes one of a ball and a socket joint for receiving a corresponding one of a socket and a ball joint of the mounting member.

13. The mount of claim 12 wherein the guide mechanism of the coupler further includes a retainer for preventing lateral rotation of the body relative to the mounting member.

14. The mount of claim 13 wherein the ball joint of the mounting member further includes a flange having a flat surface for interfacing with the retainers for preventing horizontal pivot of the body about the mounting member.

15. The mount of claim 1 wherein a length of the body is substantially greater than a width of the body.

16. The mount of claim 15 wherein the length of the body is at least 1 ft.

17. A mounting system comprising:

an adjustable-length pole, the pole including a compression mechanism to allow for compression along a longitudinal axis thereof;

an elongated body having a longitudinal axis;

a curtain interface positioned at a top surface of the body; and a coupler for rotatably coupling the pole to the body, the coupler including quick-release handles operatively coupled with retention tabs that engage the body for removably mounting the coupler to the body, and a guide mechanism that prevents horizontal pivot and lateral rotation of the body relative to the pole, while permitting longitudinal rotation of the body relative to the pole, wherein the adjustable-length pole is of a sufficient length to be fixed between a first surface of a room and a second surface of the room, the compression mechanism configured to urge the curtain interface toward one of the first surface and the second surface of the room when under compression between the first and second surfaces of the room to retain the adjustable-length pole and body in a fixed position relative to the first and second surfaces of the room.

18. The mounting system of claim 17 wherein the coupler rotatably couples the pole to the body such that the longitudinal axis of pole is parallel to, or lies in, a rotational plane of the longitudinal axis of the body.

19. The mounting system of claim 17 wherein the coupler removably couples the pole to the body.

20. The mounting system of claim 17 wherein the curtain interface comprises a compressible material.

21. The mounting system of claim 20 wherein the compressible material is one selected form the group of materials consisting of foam, polyurethane foam, extruded vinyl, and rubber strips.

22. The mounting system of claim 17 wherein the body comprises a rail.

23. The mounting system of claim 22 wherein the rail includes a U-shaped slot and wherein the curtain interface is mounted in the slot.

24. The mounting system of claim 22 wherein the rail comprises an extrusion.

25. The mounting system of claim 17 wherein the coupler is removably mountable to the body.

26. The mounting system of claim 25 wherein the coupler further includes quick-release arms that engage a feature on the body for removably mounting the coupler to the body.

27. The mounting system of claim 17 wherein the position of the coupler is adjustable relative to the longitudinal axis of the body.

28. The mounting system of claim 27 wherein the position of the coupler on the body can be adjusted variably.

29. The mounting system of claim 27 wherein the position of the coupler is determined according to indexed positions on the body.

30. The mounting system of claim 17 wherein the coupler includes a socket for receiving a ball joint of the pole.

31. The mounting system of claim 30 wherein the coupler further includes a retainer for preventing lateral rotation of the body relative to the pole.

32. The mounting system of claim 31 wherein the ball joint of the pole further includes a flange having a flat surface for interfacing with the retainers for preventing horizontal pivot of the body about the pole.

33. The mounting system of claim 17 wherein a length of the body is substantially greater than a width of the body.

34. The mounting system of claim 33 wherein the length of the body is at least 1 ft.

35. The mounting system of claim 17 wherein the coupler comprises a hinge that rotatably couples the body relative to the pole.

36. The mounting system of claim 17 wherein the coupler is constructed and arranged so that an inward force applied to the quick-release handles causes the retention tabs to flex outward so the coupler can be mounted to the body and so that when the inward force is released, the coupler is secured to the body by the retention tabs.

37. A curtain mounting system comprising:

a curtain;

a first curtain mount including a curtain coupler of a first length and a first adjustable-length pole, the curtain coupler configured to couple a first portion of the curtain at a first end of the first adjustable-length pole; and a second curtain mount, comprising:

a second adjustable-length pole;

an elongated body having a longitudinal axis, the elongated body of a second length substantially greater than the first length of the curtain coupler;

a curtain interface at an upper surface of the elongated body;

a coupler that couples the second adjustable-length pole to the elongated body so that the elongated body is rotatable relative to the second adjustable-length pole; and a compression mechanism between the curtain interface and a base of the second adjustable-length pole opposite the curtain interface, wherein the second adjustable-length pole is of a sufficient length to be fixed between a first surface of a room and a second surface of the room, the compression mechanism configured to urge the curtain interface toward one of the first surface and the second surface of the room when under compression between the first and second surfaces of the room to retain the second adjustable-length pole and the elongated body in a fixed position relative to the first and second surfaces of the room.

38. The curtain mounting system of claim 37 wherein the coupler limits lateral rotation of the elongated body relative to the second adjustable-length pole, while permitting rotation of the elongated body relative to the second adjustable-length pole in another direction of rotation.

39. The curtain mounting system of claim 37 wherein a coupling position of the coupler is adjustable over a range of positions relative to the longitudinal axis of the elongated body.

40. The mounting system of claim 37 wherein the coupler rotatably couples the second adjustable-length pole to the body such that the longitudinal axis of the second adjustable-length pole is parallel to, or lies in, a rotational plane of the longitudinal axis of the body.

41. The mounting system of claim 37 wherein the coupler removably couples the second adjustable-length pole to the body.

42. The mounting system of claim 37 wherein the curtain interface comprises a compressible material.

43. The mounting system of claim 42 wherein the compressible material is one selected form the group of materials consisting of foam, polyurethane foam, extruded vinyl, and rubber strips.

44. The mounting system of claim 37 wherein the body comprises a rail.

45. The mounting system of claim 44 wherein the rail includes a U-shaped slot and wherein the curtain interface is mounted in the slot.

46. The mounting system of claim 44 wherein the rail comprises an extrusion.

47. The mounting system of claim 37 wherein the coupler is removably mountable to the body.

48. The mounting system of claim 47 wherein the coupler further includes quick-release arms that engage a feature on the body for removably mounting the coupler to the body.

49. The mounting system of claim 37 wherein the position of the coupler is adjustable relative to the longitudinal axis of the body.

50. The mounting system of claim 49 wherein the position of the coupler on the body can be adjusted variably.

51. The mounting system of claim 49 wherein the position of the coupler is determined according to indexed positions on the body.

52. The mounting system of claim 37 wherein the coupler includes a socket for receiving a ball joint of the second adjustable-length pole.

53. The mounting system of claim 52 wherein the coupler further includes a retainer for preventing lateral rotation of the body relative to the second adjustable-length pole.

54. The mounting system of claim 53 wherein the ball joint of the second adjustable-length pole further includes a flange having a flat surface for interfacing with the retainers for preventing horizontal pivot of the body about the second adjustable-length pole.

55. The mounting system of claim 37 wherein a length of the body is substantially greater than a width of the body.

56. The mounting system of claim 55 wherein the length of the body is at least 1 ft.

57. The mounting system of claim 37 wherein the coupler comprises a hinge that rotatably couples the body relative to the second adjustable-length pole.

58. A mount comprising:

an elongated body having a longitudinal axis, a curtain interface coupled to an upper surface of the body;

a coupler adapted for coupling the elongated body to a mounting member, the coupler including an interface adapted to receive the mounting member, a coupling position of the coupler being adjustable over a range of positions relative to the longitudinal axis of the body; and a mounting member comprising an adjustable-length pole, the body being rotatable relative to the mounting member, the mounting member including a compression mechanism along a longitudinal axis thereof, the mounting member being of a sufficient length to be fixed between a first surface of a room and a second surface of the room, the compression mechanism configured to urge the curtain interface toward one of the first surface and the second surface of the room when under compression between the first and second surfaces of the room to retain the mounting member and body in a fixed position relative to the first and second surfaces of the room, wherein the position of the coupler is determined according to indexed positions on the body.

59. A mounting system comprising:

an adjustable-length pole, the pole including a compression mechanism to allow for compression along a longitudinal axis thereof;

an elongated body having a longitudinal axis;

a curtain interface coupled to an upper surface of the body; and a coupler for rotatably coupling the pole to the body, the coupler limiting lateral rotation of the body relative to the pole, while permitting rotation of the body relative to the pole in another direction of rotation, wherein the adjustable-length pole is of a sufficient length to be fixed between a first surface of a room and a second surface of the room, the compression mechanism configured to urge the curtain interface toward one of the first surface and the second surface of the room when under compression between the first and second surfaces of the room to retain the adjustable-length pole and body in a fixed position relative to the first and second surfaces of the room, and wherein the position of the coupler is determined according to indexed positions on the body.

* * * * *

UNITED STATES PATENT AND TRADEMARK OFFICE

CERTIFICATE OF CORRECTION

PATENT NO. : 7,533,712 B2
APPLICATION NO. : 10/600300
DATED : May 19, 2009
INVENTOR(S) : Jeffrey P. Whittemore It is certified that error appears in the above-identified patent and that said Letters Patent is hereby corrected as shown below:

Column 9, line 22 claim 21 delete "form" and insert --from--.
Column 10, line 50 claim 43 delete "form" and insert --from--.

Signed and Sealed this

Eighteenth Day of August, 2009

David J. Kappos

David J. Kappos
*Director of the United States Patent and Trademark Office*